US008661744B2

(12) United States Patent
Keller

(10) Patent No.: US 8,661,744 B2
(45) **Date of Patent: *Mar. 4, 2014**

(54) TELESCOPING MAST

(75) Inventor: Lars Keller, Odense (DK)

(73) Assignee: Falck Schmidt Defence Systems A/S, Odense C (DK)

( * ) Notice: Subject to any disclaimer, the term of this patent is extended or adjusted under 35 U.S.C. 154(b) by 0 days.

This patent is subject to a terminal disclaimer.

(21) Appl. No.: 12/596,266

(22) PCT Filed: Apr. 15, 2008

(86) PCT No.: PCT/DK2008/000133

§ 371 (c)(1),
(2), (4) Date: Jan. 18, 2010

(87) PCT Pub. No.: WO2008/125110

PCT Pub. Date: Oct. 23, 2008

(65) Prior Publication Data

US 2010/0146873 A1 Jun. 17, 2010

(30) Foreign Application Priority Data

Apr. 16, 2007 (DK) ..... PA 2007 00552

(51) Int. Cl.
*E04H 12/18* (2006.01)

(52) U.S. Cl.
USPC ..... 52/118; 52/111; 52/117; 52/632; 343/883

(58) Field of Classification Search
USPC ..... 52/111, 113, 117, 118, 632, 114, 121; 343/883
See application file for complete search history.

(56) References Cited

U.S. PATENT DOCUMENTS

| | | | | | |
|---|---|---|---|---|---|
| 165,472 | A | * | 7/1875 | Brinckerhoff | 91/168 |
| 639,189 | A | * | 12/1899 | Van Der Cruyssen | 472/2 |
| 815,594 | A | * | 3/1906 | Kovacevic | 182/141 |
| 1,319,943 | A | * | 10/1919 | Bessolo | 182/129 |

(Continued)

FOREIGN PATENT DOCUMENTS

| | | | |
|---|---|---|---|
| DE | 289 534 | C | 3/1913 |
| DE | 2 326 271 | A1 | 10/1974 |

(Continued)

OTHER PUBLICATIONS

International Search Report for International Application No. PCT/DK2008/000133 Dated Apr. 12, 2008.

*Primary Examiner* — Basil Katcheves
*Assistant Examiner* — Rodney Mintz
(74) *Attorney, Agent, or Firm* — Roberts Mlotkowski Safran & Cole, P.C.; David S. Safran

(57) ABSTRACT

The present invention concerns a telescopic mast which at least includes one or more telescoping joints, where a telescoping joint is formed of two telescoping sections dimensioned so that one section can be moved into another section, where between each of the two adjacent telescoping sections in a telescoping joint there is provided at least one actuator urging the adjacent telescoping sections away from each other, where these actuators are disposed internally of the telescoping joints and offset at the internal periphery. By disposing actuators offset at the inner periphery of the telescoping sections, several advantages are achieved. The actuators are provided at a protected location, and the actuators may be designed with lengths that overlap each other when the telescopic mast is collapsed.

4 Claims, 2 Drawing Sheets

(56) References Cited

U.S. PATENT DOCUMENTS

| | | | | | |
|---|---|---|---|---|---|
| 2,617,933 | A | * | 11/1952 | Noel | 52/121 |
| 3,534,659 | A | * | 10/1970 | Payson | 91/168 |
| 3,552,267 | A | * | 1/1971 | Bushnell, Jr. | 91/168 |
| 3,612,468 | A | * | 10/1971 | Hoppl et al. | 248/405 |
| 3,624,979 | A | * | 12/1971 | Przybylski | 52/115 |
| 3,658,189 | A | * | 4/1972 | Brown et al. | 212/349 |
| 3,724,885 | A | * | 4/1973 | Becker | 403/104 |
| 3,737,134 | A | * | 6/1973 | Foon | 248/354.3 |
| 3,738,075 | A | * | 6/1973 | Nansel | 52/115 |
| 3,804,262 | A | * | 4/1974 | Wiencek et al. | 212/349 |
| 3,808,946 | A | * | 5/1974 | Bell et al. | 91/168 |
| 3,831,901 | A | * | 8/1974 | Williams et al. | 254/93 R |
| 3,838,625 | A | * | 10/1974 | Bell et al. | 91/168 |
| 3,842,985 | A | * | 10/1974 | Svede | 212/264 |
| 4,016,823 | A | * | 4/1977 | Davis | 114/90 |
| 4,053,058 | A | * | 10/1977 | Jensen et al. | 212/298 |
| 4,062,156 | A | * | 12/1977 | Roth | 52/111 |
| 4,094,230 | A | * | 6/1978 | Wright et al. | 92/51 |
| 4,098,172 | A | * | 7/1978 | Wright et al. | 92/161 |
| 4,132,041 | A | | 1/1979 | Van den Broek | |
| 4,137,535 | A | * | 1/1979 | Rupprecht | 343/902 |
| 4,151,534 | A | * | 4/1979 | Bond | 343/883 |
| 4,191,092 | A | * | 3/1980 | Farmer | 91/189 R |
| 4,258,825 | A | * | 3/1981 | Collins | 182/14 |
| 4,417,646 | A | * | 11/1983 | Lindbergh | 187/405 |
| 4,434,902 | A | | 3/1984 | Goode et al. | |
| 4,590,720 | A | * | 5/1986 | Reed | 52/121 |
| 4,664,272 | A | * | 5/1987 | Mentzer | 212/348 |
| 4,691,617 | A | * | 9/1987 | Purkott | 91/167 R |
| 4,708,592 | A | * | 11/1987 | Krolick et al. | 416/176 |
| 4,714,021 | A | * | 12/1987 | Tranin | 102/401 |
| 4,793,197 | A | * | 12/1988 | Petrovsky | 74/89.35 |
| 4,864,784 | A | * | 9/1989 | Binge et al. | 52/108 |
| 4,875,555 | A | * | 10/1989 | Johansson et al. | 187/226 |
| 5,035,094 | A | * | 7/1991 | Legare | 52/118 |
| 5,099,748 | A | * | 3/1992 | Neubauer | 91/26 |
| 5,168,679 | A | * | 12/1992 | Featherstone | 52/118 |
| 5,191,828 | A | * | 3/1993 | McCreery | 92/165 R |
| 5,218,375 | A | * | 6/1993 | Hillman | 343/883 |
| 5,234,187 | A | * | 8/1993 | Teppo et al. | 248/161 |
| 5,279,084 | A | * | 1/1994 | Atsukawa | 52/118 |
| 5,315,795 | A | * | 5/1994 | Chae et al. | 52/113 |
| 5,390,586 | A | * | 2/1995 | Jones | 92/79 |
| 5,443,573 | A | * | 8/1995 | Thiele et al. | 267/64.12 |
| 5,492,430 | A | * | 2/1996 | Jones | 403/109.5 |
| 5,537,125 | A | * | 7/1996 | Harrell et al. | 343/878 |
| 5,624,046 | A | * | 4/1997 | Zimmermann | 212/349 |
| 5,628,416 | A | * | 5/1997 | Frommelt et al. | 212/292 |
| 5,660,495 | A | * | 8/1997 | Atsukawa | 403/377 |
| 5,983,778 | A | * | 11/1999 | Dawson | 92/52 |
| 6,152,638 | A | * | 11/2000 | Lindsay | 403/109.5 |
| 6,234,062 | B1 | * | 5/2001 | Griffin | 92/23 |
| 6,244,450 | B1 | | 6/2001 | Woodling | |
| 6,276,811 | B1 | | 8/2001 | Yoshimori et al. | |
| 6,361,002 | B1 | * | 3/2002 | Cheng | 248/161 |
| 6,408,763 | B1 | * | 6/2002 | Hurtta et al. | 102/404 |
| 6,484,456 | B1 | | 11/2002 | Featherstone et al. | |
| 6,526,901 | B2 | * | 3/2003 | Iacoboni | 114/90 |
| 6,601,719 | B2 | * | 8/2003 | Harrington | 212/292 |
| 6,767,115 | B2 | * | 7/2004 | Blackwelder | 362/385 |
| 6,899,014 | B2 | * | 5/2005 | Dawson | 92/52 |
| 7,234,847 | B2 | | 6/2007 | Yoshimori et al. | |
| 7,497,140 | B2 | * | 3/2009 | Blackwelder et al. | 74/89.28 |
| 7,685,929 | B2 | * | 3/2010 | Mainville | 92/51 |
| 7,854,555 | B2 | * | 12/2010 | Chapman | 396/428 |
| 7,896,366 | B2 | * | 3/2011 | Campbell et al. | 280/43.17 |
| 8,408,083 | B2 | * | 4/2013 | Nielsen et al. | 74/89.23 |
| 8,494,725 | B2 | * | 7/2013 | Zurfluh | 701/49 |
| 2002/0139284 | A1 | * | 10/2002 | Iacoboni | 114/90 |
| 2003/0095411 | A1 | | 5/2003 | Blackwelder | |
| 2003/0107525 | A1 | * | 6/2003 | Ehrenberg et al. | 343/881 |
| 2003/0213765 | A1 | * | 11/2003 | St-Germain | 212/294 |
| 2004/0060887 | A1 | * | 4/2004 | Willim | 212/348 |
| 2004/0154237 | A1 | * | 8/2004 | Mainville | 52/118 |
| 2005/0005562 | A1 | * | 1/2005 | Henderson et al. | 52/633 |
| 2005/0163565 | A1 | * | 7/2005 | Quenzi et al. | 404/84.1 |
| 2005/0178616 | A1 | * | 8/2005 | Bouchard | 182/129 |
| 2006/0102783 | A1 | * | 5/2006 | Dennis et al. | 244/110 F |
| 2007/0058968 | A1 | * | 3/2007 | Chapman | 396/428 |
| 2007/0125599 | A1 | * | 6/2007 | Campbell et al. | 182/148 |
| 2008/0047755 | A1 | * | 2/2008 | Trevisani | 175/85 |
| 2008/0253866 | A1 | * | 10/2008 | Lops et al. | 414/22.55 |
| 2009/0145056 | A1 | * | 6/2009 | Pereira | 52/111 |
| 2009/0211174 | A1 | * | 8/2009 | Henderson et al. | 52/40 |
| 2009/0249904 | A1 | * | 10/2009 | Chen et al. | 74/89.23 |
| 2009/0249905 | A1 | * | 10/2009 | Chen et al. | 74/89.37 |
| 2009/0249906 | A1 | * | 10/2009 | Chen et al. | 74/89.37 |
| 2009/0318754 | A1 | * | 12/2009 | Ettmer | 600/38 |
| 2010/0050557 | A1 | * | 3/2010 | Falck-Schmidt | 52/632 |
| 2011/0033293 | A1 | * | 2/2011 | Cavalieri | 416/9 |
| 2011/0072737 | A1 | * | 3/2011 | Wasterval | 52/115 |
| 2011/0196581 | A1 | * | 8/2011 | Zurfluh | 701/49 |
| 2011/0234464 | A1 | * | 9/2011 | Hall | 343/765 |
| 2012/0043158 | A1 | * | 2/2012 | Campbell et al. | 182/69.4 |
| 2013/0161128 | A1 | * | 6/2013 | Watson et al. | 182/141 |

FOREIGN PATENT DOCUMENTS

| | | | | |
|---|---|---|---|---|
| DE | 20 2004 019 021 | U1 | | 5/2006 |
| EP | 0 114 377 | A1 | | 8/1984 |
| EP | 114377 | B | * | 10/1986 |
| EP | 0 456 007 | A2 | | 11/1991 |
| EP | 0 495 507 | A1 | | 7/1992 |
| EP | 1881151 | A1 | * | 1/2008 |
| JP | 07330292 | A | * | 12/1995 |
| JP | 2003201774 | A | * | 7/2003 |
| JP | 2004232372 | A | * | 8/2004 |
| WO | WO 2006059072 | A1 | * | 6/2006 |

* cited by examiner

TELESCOPING MAST

FIELD OF THE INVENTION

The present invention concerns a telescopic mast including at least one or more telescoping joints with parallel walls, where one of two adjacent telescoping sections is narrower than the other of the two adjacent telescoping sections, so that a first telescoping section can be moved into and out of, respectively, of a second telescoping section in a telescoping joint as well as the second section may be moved into and out of a third telescoping section in a further telescoping joint, where between each of two adjacent telescoping sections in a telescoping joint there is provided at least one actuator, preferably several actuators, adapted to urge the adjacent telescoping sections away from each other, where these actuators are disposed internally of the telescoping joints.

DESCRIPTION OF PRIOR ART

There are many kinds of telescopic masts of which some can be extended automatically. In connection with such telescopic masts for military applications, there are particular requirements to usability and to operability in extreme situations and weather conditions as well.

U.S. Pat. No. 4,151,534 describes a free-standing mast for an antenna including a number of telescoping tubes. U.S. Pat. No. 4,137,535 describes a telescopic mast which is controlled pneumatically. The mast includes a number of telescoping tubes that may be collapsed in a base section. A piston is integrated in each section. None of these inventions fulfil the requirements to a simple, efficient and sturdy solution.

Telescopic masts can be very high and may be used for sensors and weapons as well as for pointing out targets. High telescopic masts contain many telescoping sections and it is expedient that the latter are not heavier or larger in size than necessary. In order to live up to requirements to reliability and sturdy construction, it is a clear disadvantage for a telescopic mast if the technology comprises frail technical solutions wherein failures may arise, causing the telescopic mast not be operated rapidly, accurately and under all conditions.

In connection with high telescopic masts it is thus very advantageous if these are built up of simple components which, irrespectively of the conditions, provide a simple and uncomplicated use and operation. None of the prior art solutions fulfil these demands.

OBJECT OF THE INVENTION

The object of the present invention is to provide a telescopic mast wherein the mast may be extended and collapsed rapidly, and wherein the mechanism therefore is simple and efficient.

DESCRIPTION OF THE INVENTION

As mentioned in the introduction, the invention concerns a telescopic mast which at least includes one or more telescoping joints, where a telescoping joint consists of two telescoping sections dimensioned so that one section can be moved into another section, where between each of two adjacent telescoping sections in a telescoping joint there is provided at least one actuator urging the adjacent telescoping sections away from each other, where these actuators are disposed internally of the telescoping joints and mutually offset at the internal periphery, and wherein at least one actuator and preferably several actuators mounted in a telescoping joint are independent of one or more further actuators which are mounted in one or more further telescoping joints or in the same telescoping joint.

By disposing actuators offset at the inner periphery of the telescoping sections, several advantages are achieved. The actuators are provided at a protected location, and the actuators may be designed with lengths overlapping each other when the telescopic mast is collapsed. Exactly this technical feature makes this solution substantially different from prior art solutions, as the latter are often equipped with serially connected actuators which thus only allow the collapsed telescopic mast to be drawn together to the sum of the length of the actuators. The advantage achieved by the protecting internal disposition is particularly attractive in connection with using a mast according to the invention for military purposes, where a mast with visible actuators may possibly be destroyed by firing at the visible actuators.

By a telescopic mast according to the invention where the at least one actuator and preferably several actuators are mounted in a telescoping joint and are independent of one or more further actuators which are mounted in one or more further telescoping joints or in the same telescoping joint, great reliability is achieved. By such a solution is achieved a mechanically simple and sturdy construction where two adjacent telescoping sections by triggering an extending of the mast are urged away from each other by an actuator mechanism which is not mechanically connected to other corresponding actuator mechanisms in further telescoping joints in the same telescoping mast. This extension is effected without using complicated cord or wire connections that extend the mast via pulleys and the like. By placing the actuators in the telescoping joints so that they are mutually offset in each section, as mentioned above there is achieved the great advantage that the telescopic mast may be collapsed or drawn together more than traditional telescopic masts with built-in actuators.

Moreover, a more sure operation is achieved by having several actuators, e.g. 2, 3 or maybe even 6 or more actuators at each telescoping joint. By a system according to the invention, if one actuator is damaged none but that particular actuator will be influenced. If a telescoping joint only has one actuator and this is damaged, the joint in question will no longer be able to be pressed out, but the mast as a whole will only suffer from the disadvantage that it is no longer extended in full length. If, however, there are more actuators at every joint, the mast may be used in full length irrespectively of one or possibly more actuators being damaged. By such a solution is achieved a telescopic mast with great redundancy.

One variant of a telescopic mast is equipped with actuators of the type linear actuators, where the direction of movement is substantially parallel with the longitudinal direction of the telescoping sections. A preferred actuator type is the so-called gas springs. The choice of actuators may of course be adapted to need, and possibly other combinations of various types may be used, including electric, hydraulic or pneumatic actuators, and unmentioned types may be applied as well.

Particularly actuators of the type called gas springs are suited for use in connection with a telescopic mast according to the invention, as no other operations are to be performed other than triggering the mast for pushing it out to the desired length. Furthermore, it is advantageous that if an actuator of this type is damaged, the mast may still be pulled down, the actuator being easy to replace and not requiring filling of pressurised fluid, such as oil or air, and no connecting to an electric system either. It is thus not the entire actuator system that is paralysed if a single actuator is damaged, and the mast is still at least partly operational.

Furthermore, an advantage by a mast with actuators as disclosed is that it may be extended without using external connections, thus not requiring a noisy pump in order to be extended. Extension as well as collapsing may thus be performed without disturbing noise.

A telescopic mast according to the invention may be designed such that the telescoping sections are constituted by cylindric profiles. However, in a particularly preferred embodiment, the telescoping sections can be designed as edged profiles, more specifically as octagonally profiled pipes which advantageously may be wound fibre composite tubes, e.g. carbon fibre reinforced epoxy tubes. Pipes or tubes of this kind have the great advantage that they are very rigid, and if they are made of carbon fibre reinforced epoxy, they are at the same time very light compared with other fibre composites or metals. In that way is achieved a stable and light telescopic mast with very high rigidity and strength.

In a particularly preferred variant of the telescopic mast according to the invention, the telescoping sections may be drawn together by a draw wire which is fastened internally at the upper end of the telescopic mast. The draw wire may, for example, be fastened at the uppermost and thinnest telescoping section and thus run inside the mast, where it is rolled up on a reel at the foot of the mast. This rolling up may be effected manually, hydraulically or by another suitable method. A clear advantage is, however, that the mast may be drawn back manually at any time in case of occurring supply problems with the usual drive power. Such a withdrawal may possibly be effected by a crank handle or by an electric drill or similar.

The internally disposed actuators may be of a type that may be locked at any position, but preferably there is used a type which is normally extended and held back by the said draw wire. By extending a telescopic mast by such actuators, the mast will typically be extended from the bottom so that the largest telescoping joints are extended at first and the lesser ones subsequently, as the actuators in these telescoping joints will be the strongest. However, there may also be masts adapted for extending all sections at one and the same time.

In addition, the actuators may be provided with the option of being locked at various positions corresponding to various heights. Such a locking may be effected manually or via remote control to one or more actuators or to a device in connection with one or more actuators.

A mast may thus be extended and locked at a certain height. At the same time, in this way it may be controlled which telescoping joints are to be extended and how much the individual joints are to be extended.

A telescopic mast according to the invention may advantageously be designed so that a pipe is provided inside the telescoping sections. Supply lines and cables of various kinds used in connection with equipment disposed at the top of the telescopic mast may be arranged in this pipe. For example, this may be antenna equipment, surveillance equipment, lamps, weapons or other equipment.

SHORT DESCRIPTION OF THE DRAWING

The invention is described in more detail with reference to the drawing, wherein.

DETAILED DESCRIPTION OF THE INVENTION

Figure 1:
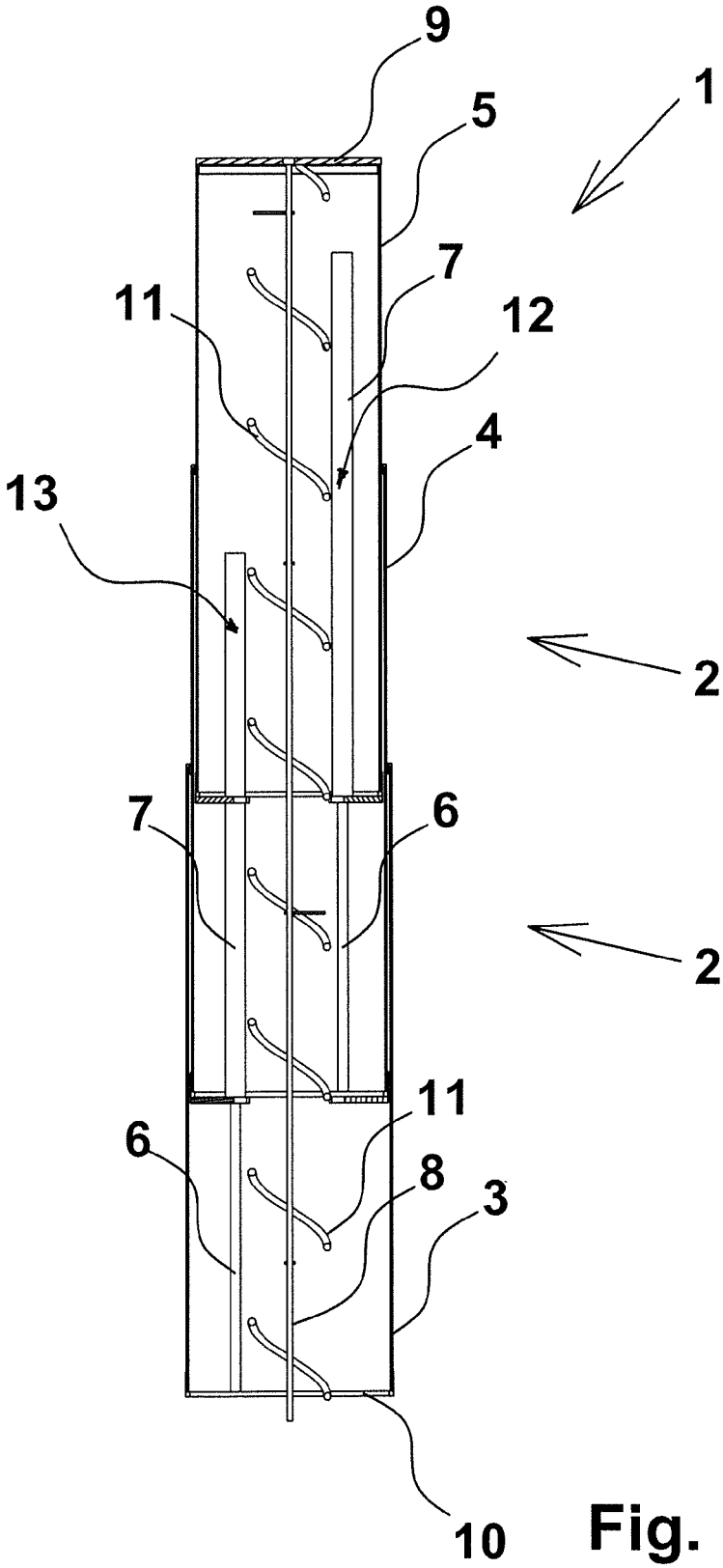
FIG. 1 shows a telescopic mast in cross-section and in partially extended position.

In FIG. 1 appears a telescopic mast 1 with two telescoping joints 2 which thus consists of three telescoping sections 3, 4, 5, here shown in partially extended position. Internally of the telescopic mast 1 is seen linear actuators which here appear as gas springs 12, 13 with a piston rod 6 and cylinder housing 7. These gas springs 12, 13 are mounted mutually displaced or offset at the inner periphery in the telescopic mast so that the gas springs 12, 13 do not interfere with each other when drawing the telescopic mast 1 together.

Furthermore, there is seen a pull cord 8, e.g. a steel wire, which is connected to the top 9 of the telescopic mast and extends down to the bottom 10 of the telescopic mast 1 and on to a not shown reel or the like, upon which the pull cord 8 may be rolled up for pulling the telescopic mast 1 down, or wherefrom it may be slackened in order to extend the telescopic mast 1 partly or entirely. Furthermore, there is seen a helical cable or conductor 11 which by extension of the telescopic mast 1 is extended and also collapsed when drawing the mast 1 together. This helical cable 11 may be an electric conductor for conducting electricity for powering equipment in top 9 of the telescopic mast, but may also be a conductor for various electric signals, such as radio waves or the like. By placing such a helical conductor 11 inside the mast there is achieved the obvious advantage that the conductor is provided in a protected environment where it is not damaged during transport or during use.

Figure 2:
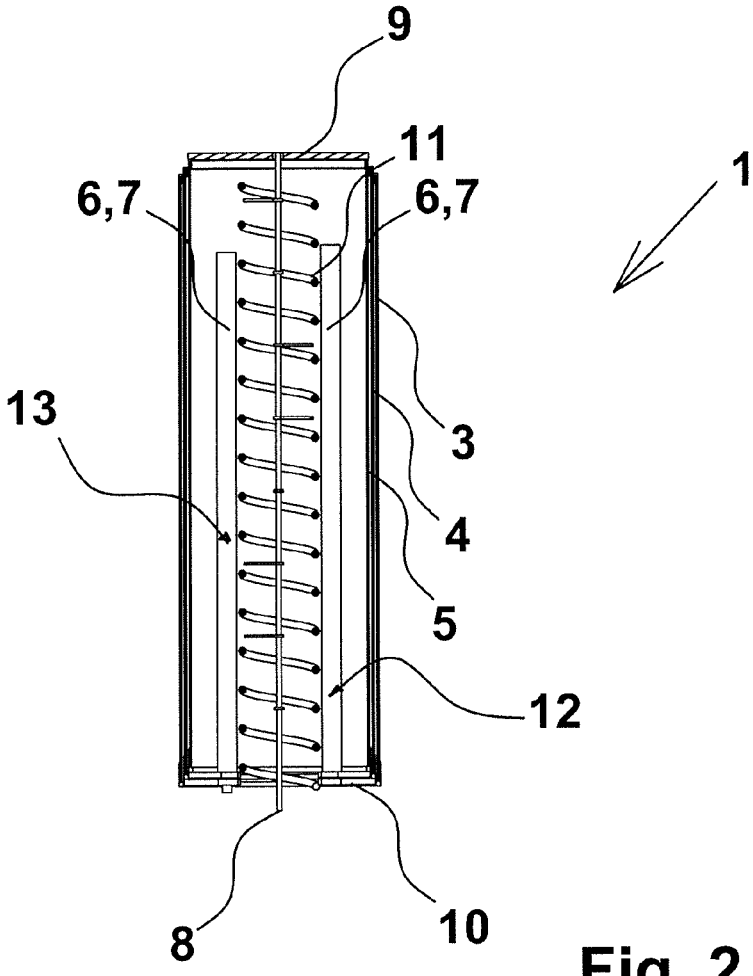
FIG. 2 shows a telescopic mast in collapsed position.

In FIG. 2 appears a telescopic mast 1 where all telescopic sections 3, 4, 5 are drawn together, thus not taking up substantially more space than one telescoping section 3. The gas springs 12, 13 and pull cord 8 are shown in the telescopic mast 1 in the most collapsed position.

Figure 3:
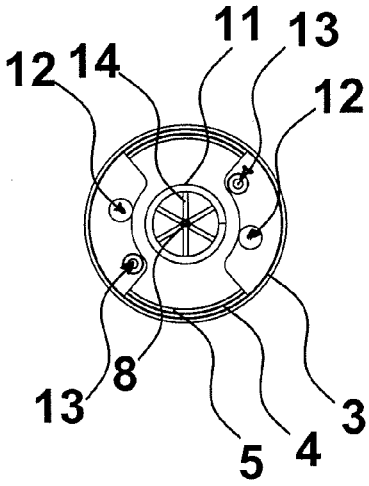
FIG. 3 shows a telescopic mast as seen from the bottom.

In FIG. 3, the telescopic mast 1 is seen from the bottom 10, where the positions of gas springs 12, 13 appear along the internal periphery of the telescoping sections 3, 4, 5. In the shown variant, two connected gas springs 12 are fitted for one telescoping joint 2 and two other connected gas springs 13 for the other telescoping joint 2. By such a solution, the individual telescoping section 3, 4, 5 is not acted on asymmetrically as a consequence of the gas spring not being disposed at centre of the telescopic mast 1. However, it is obvious that a mast with only one gas spring or actuator may operate in a satisfactory way if this problem is taken into account at the design stage of the telescoping joints 2. By a solution as described, it is possible to use actuators 12, 13 which are balanced in strength in relation to the weight of the actual telescoping section 3, 4, 5. Typically, an actuator 12, 13 with somewhat lesser strength may thus be used at the uppermost telescoping joint 2 as in the gradually larger, underlying telescoping joints 2.

The helical cable 11, here shown with guide connections 14 connected with the draw cord 8, is seen inside the telescopic mast. These guide connections ensure that the helical cable 11 does not get jammed inside the telescopic mast 1 and that it is pulled out evenly in connection with the extending of the telescopic mast 1, as the guide connections 14 are fixed to the draw cord 8 with even spacing.

The invention claimed is:

1. A telescopic mast including at least two telescoping joints, each of which is formed by two adjacent telescoping sections with parallel walls, where one of the two adjacent telescoping sections of each joint is narrower than the other of the two adjacent telescoping sections, so that one of the telescoping sections can be moved into and out of, respectively, the other of the telescoping sections of each telescoping joint where, extending between each of the two adjacent telescoping sections of each telescoping joint is provided at least one linear actuator, said at least one linear actuator being positioned and oriented parallel with a longitudinal axis of the telescoping sections in a manner adapted to urge the adjacent telescoping sections away from each other in a direction of movement substantially parallel with said longitudinal axis of the telescoping sections, wherein said at least one linear actuator is disposed internally of the telescoping joints, wherein the at least one linear actuator of each of the at least two telescoping joints in the telescopic mast are mutually offset relative to an internal periphery of said telescopic mast, wherein the at least one linear actuator of one of the at least two telescoping joints is completely independent of the at least one linear actuator of the other of the at least two telescoping joints, wherein said actuators are gas springs, and wherein the telescoping sections are drawn together by a draw wire which is fastened internally at an upper end of the telescopic mast.

2. The telescopic mast according to claim 1, wherein a helical conductor cable is provided inside the telescoping sections.

3. The telescopic mast according to claim 1, wherein the telescoping sections are constituted by cylindric profiles.

4. The telescopic mast according to claim 1, wherein the telescoping sections are constituted by edged profiles.

* * * * *